United States Patent [19]

Griese et al.

[11] Patent Number: 4,681,514

[45] Date of Patent: Jul. 21, 1987

[54] RADIAL PISTON PUMP HAVING SEALING DISC

[75] Inventors: Klaus Griese, Kupferzell; Siegfried Mayer, Vaihingen/Enz; Dieter Weigle, Bad Urach, all of Fed. Rep. of Germany

[73] Assignee: Robert Bosch GmbH, Stuttgart, Fed. Rep. of Germany

[21] Appl. No.: 830,681

[22] Filed: Feb. 18, 1986

[30] Foreign Application Priority Data

Apr. 12, 1985 [DE] Fed. Rep. of Germany ..... 3513164

[51] Int. Cl.[4] ..... F04B 49/00; F04B 1/04

[52] U.S. Cl. ..... 417/213; 417/214; 417/270; 417/273

[58] Field of Search ..... 417/273, 213, 214, 270, 417/490; 92/72; 91/491

[56] References Cited

U.S. PATENT DOCUMENTS

| | | | |
|---|---|---|---|
| 3,002,462 | 10/1961 | Raymond | 417/214 X |
| 3,418,937 | 12/1968 | Cardillo et al. | 417/273 X |
| 3,434,428 | 3/1969 | Liles | 417/270 |
| 3,982,855 | 9/1976 | Aldinger et al. | 417/270 |
| 4,610,606 | 9/1986 | Hazzard et al. | 417/273 |

FOREIGN PATENT DOCUMENTS

| | | | |
|---|---|---|---|
| 2155789 | 5/1973 | Fed. Rep. of Germany | 417/273 |
| 2404762 | 8/1975 | Fed. Rep. of Germany | 417/273 |
| 2616437 | 10/1977 | Fed. Rep. of Germany | 417/273 |
| 2732247 | 2/1979 | Fed. Rep. of Germany | 417/273 |
| 2817173 | 10/1979 | Fed. Rep. of Germany | 417/270 |
| 586095 | 12/1924 | France | 417/569 |
| 2030642 | 4/1980 | United Kingdom | 417/214 |

*Primary Examiner*—Carlton R. Croyle
*Assistant Examiner*—Paul F. Neils
*Attorney, Agent, or Firm*—Michael J. Striker

[57] ABSTRACT

A pump comprising a housing and two end covers receiving a drive shaft with an eccentric thereon and with a plurality of radial pistons displaceable in radial bores provided in the housing and biased by springs. An inlet passage and an outlet passage are provided in each bore receiving the radial piston. A sealing disc is inserted between the housing and one of the end covers. Sealed through openings for high pressure medium are provided in the sealing disc. The maximal feeding flow of the pressure medium is limited by throttled passages provided in the sealing disc. A pressure control valve is provided, which is connected to an inner chamber of the housing, accommodating the eccentric.

12 Claims, 8 Drawing Figures

RADIAL PISTON PUMP HAVING SEALING DISC

BACKGROUND OF THE INVENTION

The present invention relates to a radial piston pump which normally includes a plurality of radial pistons displaceable in radial bores formed in the housing of the pump which is closed at two sides thereof by end covers.

Radial piston pumps of the foregoing type also include a drive shaft and an eccentric mounted on said shaft and positioned in an inner chamber of the housing. The pump under discussion has a so-called suction pressure control, by means of which a control member is adjusted by a pressure-loaded piston when a predetermined feeding amount is reached so that the feed of the pressure medium to the bores receiving the radial pistons is interrupted. This situation takes place within a predetermined switching period in which the pump operates for a larger period of time without pressure. Such a device, which is disclosed, for example in DE-OS No. 21 55789, is expensive, complicated and therefore troublesome.

SUMMARY OF THE INVENTION

It is an object of the present invention to provide an improved radial piston pump.

It is another object of the present invention to provide a pump in which a feed pressure limitation would be obtained by simple means, that is without movable parts.

Yet another object of the invention is to provide a radial piston pump which can be controlled independently from the loading pressure and which would not pump the medium at a predetermined loading pressure.

These and other objects of the present invention are attained by a pump comprising a housing formed with a plurality of radially extending bores receiving a plurality of radial pistons; a drive shaft; an eccentric arranged on said shaft, said pistons having inner faces supported on said eccentric; two end covers supporting said shaft at two ends thereof and closing said housing, each bore having an outlet passage; a plurality of outlet valves each positioned in a respective bore and connected to a respective outlet passage, each outlet valve including a valve body, a spring loading said valve body in a closing direction, and a valve seat; a plurality of suction passages formed in said end covers, and opening into said bores; and a sealing disc positioned between one of said end covers and a side of said housing facing said one end cover, said sealing disc having a sealed through passage connecting said outlet passages to each other, and throttling passages for each suction passage.

Sealings may be provided at two sides of said through passage.

The sealings may be glued to said sealing disc or vulcanized on that disc.

The valve body may have a disc shape, said spring being a disc-shaped spring biasing said valve body towards said valve seat.

The valve body has a head on which said disc-shaped spring acts, said spring also operating as a centering spring, each of said bores being closed with a closing bolt having a cylindrical recess, said spring having an outer end fitted in said recess and an inner end supported at and surrounding said head.

Two disc-shaped springs may be provided, said valve body having a shaft extended through a hole formed in said valve seat, said springs acting on said shaft in the closing direction.

It is particularly advantageous that the pump can be formed as a multiple pump to pump pressure medium to a plurality of consumers; then the sealing disc may be formed with two through passages separated from each other for respective outlet passages for individual pump outlets.

The housing has an inner chamber accommodating said eccentric; the pump may further include a pressure control valve arranged in connection with said inner chamber, and a plurality of springs each acting on a respective piston whereby said eccentric is set under pressure by said pressure control valve in dependence upon a loading pressure available in a consumer line and each piston is lifted by said said pressure from said eccentric against a force of a respective spring.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 2:
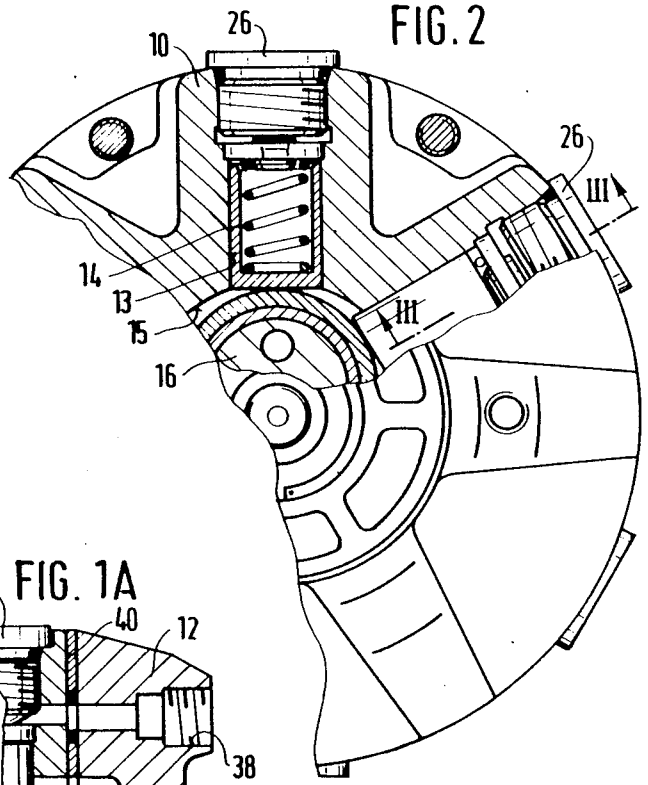
FIG. 2 is a partial front view, partially in section, of the radial piston pump, at the drive side thereof.
Figure 1A:
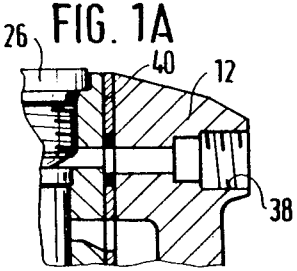
FIG. 1A is a partial section of FIG. 1.
Figure 1:
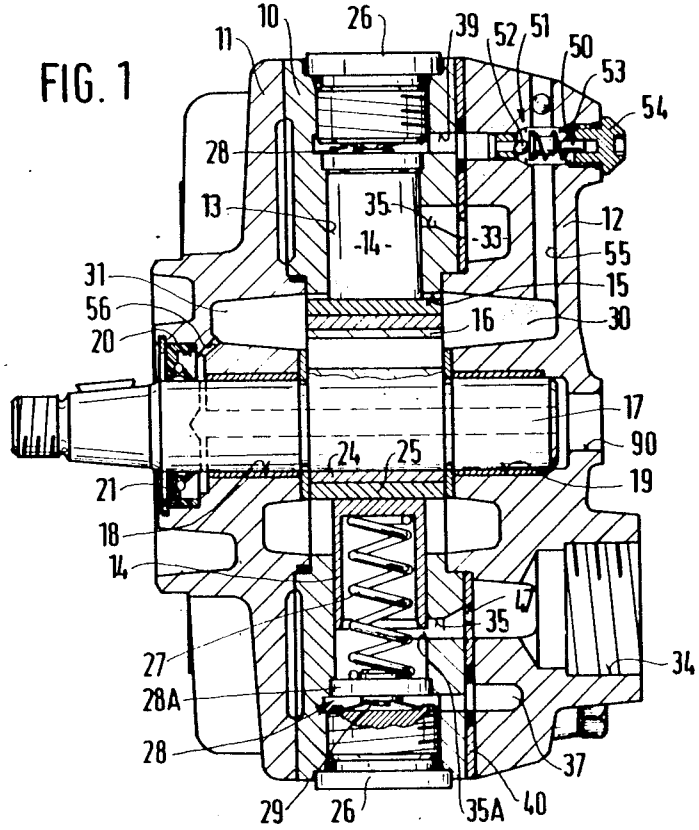
FIG. 1 is an axial sectional view of the radial piston pump according to the invention.

Referring now to the drawings in detail and firstly to FIGS. 1 and 2, it will be seen that the radial piston pump as shown is formed as a so-called plate pump and has a housing central portion 10 which is closed at two sides with end plates or housing covers 11 and 12. The housing central portion is of a cast metal and has a plurality of radial bores 13 in which radial pistons 14 are slidingly guided. A central cylindrical recess 15 is also provided in the housing central portion 10. An eccentric 16 of a drive shaft 17 is positioned in an inner chamber or recess 15 of the housing. The drive shaft is supported in aligned central bores 18 and 19 of the end covers 11 and 12. An enlarged portion 20 of the bore 18 receives a shaft sealing 21.

Two sleeves 24 and 25 float about the eccentric 16. The undersides of the hollow cylindrical pistons 14 are supported on the sleeves 24 and 25. Bores 13 which receive radial pistons 14 are closed at their outer sides by means of closing bolts 26. A compression spring 27 is positioned in each hollow piston 14, which spring is, on the one hand, supported against the inner wall of the body of the piston and, on the other hand, against a flat seat 28A of a valve body 29 of an outlet valve 28. Valve 28 and spring 27 are shown in greater detail in FIGS. 3 and 4.

A ring-shaped passage 30 is formed in end cover 12, which passage extends around bore 19. A similar ring-shaped passage 31 extending around bore 18 is formed in the end cover 11. An annular passage 33 which is formed radially outwardly of passage 30 in the end cover 12 opens into an inlet bore 34 provided in the end cover 12. A passage 35 formed in each bore 13 receiving the respective piston is in communication with the annular passage 33. The outer end of each passage 35 is designated by a reference numeral 35*a* and forms a control edge.

A further ring-shaped passage 37 formed in the end cover 12 is in connection with an outlet bore 38 shown in FIG. 1A. A further passage 39 (FIG. 3) which is in connection with the ring-shaped passage 37, which eventually opens into each one of the bores 13, is provided outside the outlet valve 28.

Figure 5:
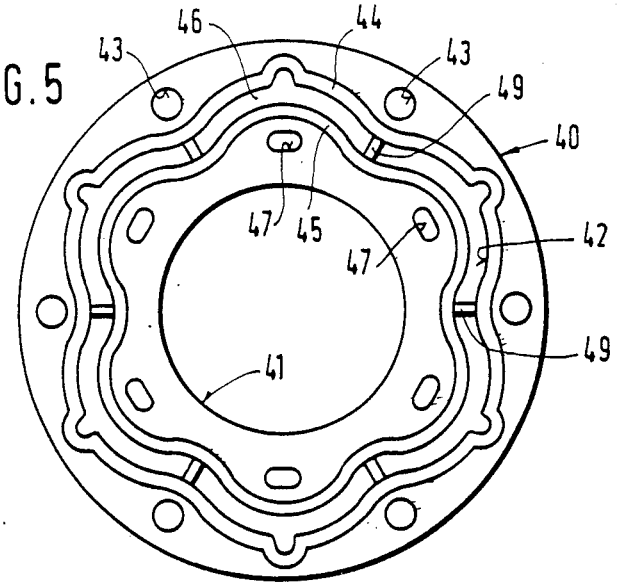
FIG. 5 is a front view of the sealing disc.

A thin sealing disc 40 is positioned between the central housing portion 10 and the end cover 12. This sealing disc is illustrated in greater detail in FIG. 5. Sealing disc 40 has thin cross-pieces 49 which interrupt a substantially circular passage 42 formed around a central bore 41 of the disc. Passage 42 has, due through openings 43, the shape of a wavy ring. Passage 42 forms a through passage from the ring-shaped passage 37 to passages 39 surrounding the outlet valves 28 of each radial piston and connected to respective bores 13. This connection takes place at the outwardly projecting convexity 46 of the passage 42.

Two sealings 44 and 45 are provided for better sealing. Sealings 44 and 45 are secured to the disc 40 at the inner side and the outer side of the passage 42 by gluing or vulcanization. Sealings 44 and 45 can be pressed to the sealing disc 40 by a screen printing method. Within each convexity or bulge 46, is formed an aperture 47 formed as a through passage of each bore 13. Each aperture 47 forms a connection from the ring-shaped passage 33 to the passage 35 and serves for a so-called suction throttling. A stepped bore 50 (FIG. 1) provided in the end cover 12 opens into the ring-shaped passage 37. A pressure-limiting valve 51 is positioned in the stepped bore 50. This pressure-limiting valve 51 is comprised of a ball-shaped valve body 52 and a spring 53 which loads the valve body 52. The stepped bore 50 is closed from outside by a closing bolt 54. The stepped bore 50 is in connection with a bore 55 which in turn opens into the ring-shaped passage 30. The latter is in connection with a throttle opening 56 formed in the end cover 11 and extending up to a bore 20 which receives the aforementioned sealing ring 21.

Figure 3:
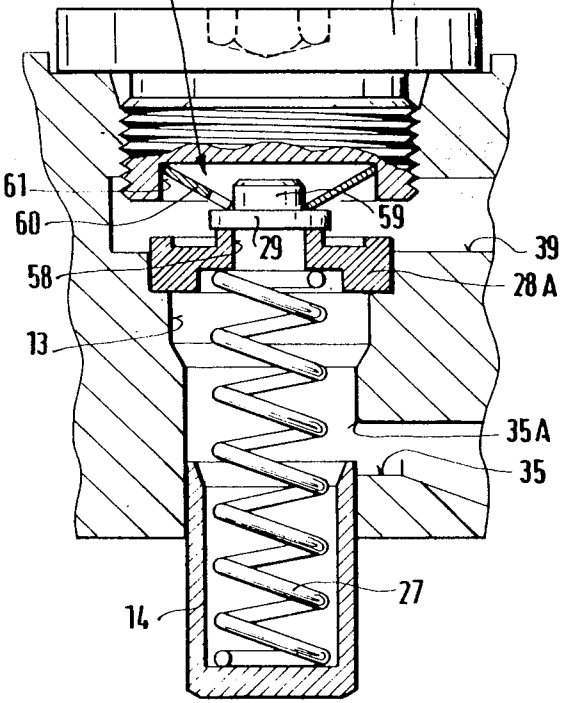
FIG. 3 is a sectional view of the piston with an outlet valve.

With reference to FIG. 3 it will be seen that the outlet valve 28 has, as mentioned above, the flat seat 28A in the form of a ring. This flat seat is inserted in the upper edge portion of the bore 13. The flat seat 28A has a central through opening 58 which is closed by a valve body 29. The latter has a central cylindrical projection 59 facing the closing bolt 26. An inner ring of a disc-shaped spring 60 is supported against the peripheral surface of the projection 59 while the outer rim or end of this spring is supported in a cylindrical recess 61 of the closing bolt 26. The disc-shaped spring 60 acts as a centering spring for the valve body 29. The flat valve seat 28A is pressed in the enlarged section of bore 13, namely against the shoulder formed in this bore and at the same time is maintained under pressure.

The mode of operation of the above described radial piston pump is rather simple. A stroke motion is imparted to all pistons 14 by the drive shaft 17. In the lower dead-center position, the passage 35 opens so that a pressure medium can flow via the inlet bore 34 and openings 47 in the sealing disc 40 into the bores 13. The amount of the pressure medium sucked through the apertures 47 in the sealing disc 40 is limited whereby the limitation of the flow of the pressure medium to be conveyed is obtained. In accordance with a predetermined outward stroke, the upper edge of the piston 14 closes the control edge 35A so that a pressure stroke is applied. Thereby the valve body 29 is lifted from its flat seat 28A. The pressure medium now flows through the passage 39 and the outlet bore 38 to a consumer.

If an opening pressure is reached at the pressure-limiting valve 51 the pressure medium will flow through this valve and the bore 55 into the ring-shaped passage 30 which is connected with a leakage oil connection 90 via the throttle bore 56. Thereby such an internal pressure occurs in the recess 15 of the housing that pistons 14 are lifted from the eccentric 16. The pump then conveys no pressure medium. When now the pressure falls again and the pressure-limiting valve closes the pistons 14 will again urged by compression springs 27 towards the eccentric 16.

Figure 4:
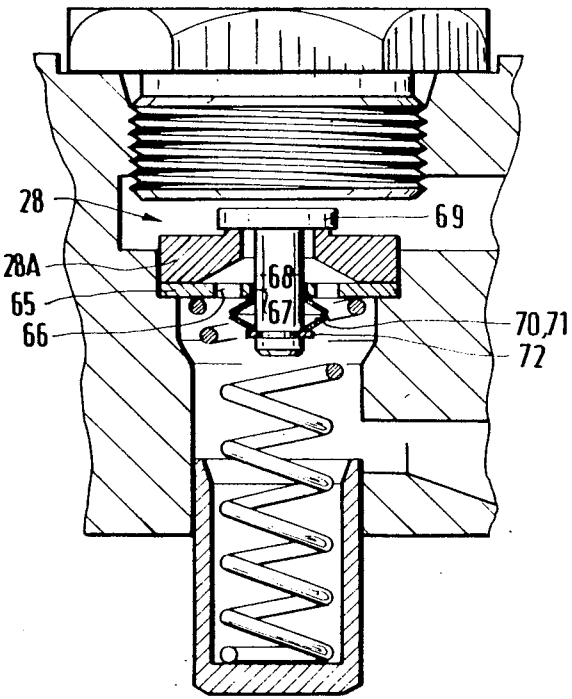
FIG. 4 is a sectional view of the piston in accordance with a modified embodiment.

Such a pressure control can, however, be obtained in another fashion. A modified embodiment is depicted in FIG. 4. In this embodiment, the valve flat seat 28A is pressed in the enlarged portion of each bore 13. However, this flat seat is not supported immediately against the shoulder formed in bore 13 but is positioned on a washer 65 in which a plurality of through openings 66 are provided. The washer 65 has a central bore 67 which receives a shaft 68 of a valve body 69. Shaft 68 is guided in bore 67 with a play. Two disc-shaped springs 70 and 71 are arranged at the lower portion of the shaft 68. Springs 70 and 71 are pre-stressed by a circlip 72 so that the springs urge the valve body 69 against the valve seat 28A. The function of the outlet valve in this embodiment is the same as for the embodiment of FIG. 3.

Figure 6:
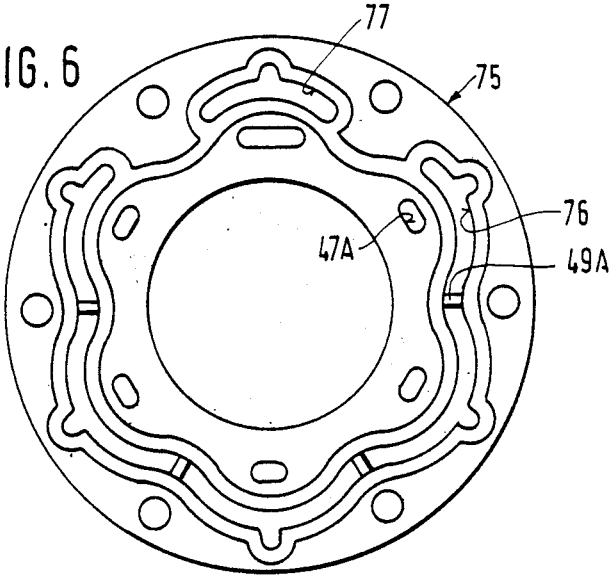
FIG. 6 is a front view of the modified sealing disc.

The pump according to the present invention can be formed as a multiple pump. Such a multiple pump would have, for example two outlet passages and would require a different sealing disc. Such a sealing disc is designated by reference numeral 75 and is shown in FIG. 6. The sealing disc 75 is substantially similar to disc 40 of FIG. 5 but has a first passage 76 which corresponds to a plurality of the piston-receiving bores and a second passage 77 which is assigned to only one piston-receiving bore. In this case a second consumer line which contains respectively less pressure medium is closed.

Figure 7:
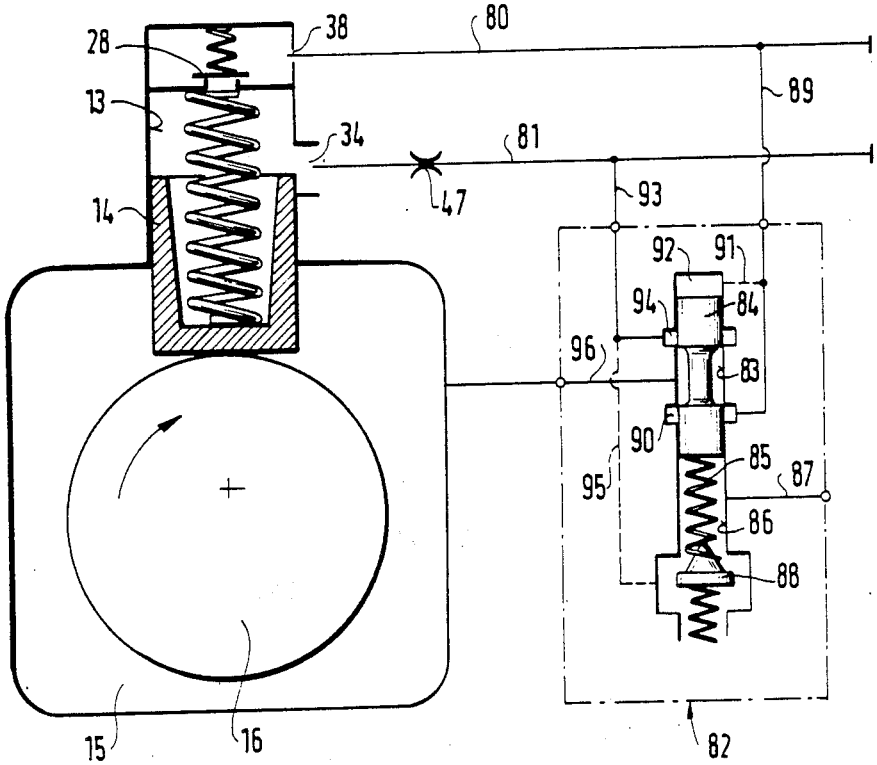
FIG. 7 is a schematic view of the control device.

The pressure control for lifting the pistons 14 from the eccentric 16 at a predetermined feeding pressure can be seen from the schematic representation shown in FIG. 7. A consumer line 80 is connected to the outlet 38 while a suction line or conduit 81 is connected to the inlet 34. Apertures 47 for suction throttling are positioned either in the suction line 81 or before the latter. A pressure control valve 81 is provided in the system, in which valve a slide bore 83 is formed. A control slide 84 is guided in bore 83. This control slide is biased at its underside by a control spring 85. The spring 85 is positioned in a chamber 86 of the slide bore 83 into which a conduit 87 opens. A loading pressure to the consumer is effective in the conduit 87. A pressure-limiting valve 88 is positioned in the lower portion of the chamber 86.

This pressure-limiting valve is adjusted to a material pressure. A conduit 89 is branched off the line 80. This conduit 89 opens into an annular groove 90 of the slide bore 83. A conduit 91 is branched off the conduit 89. Conduit 91 in turn opens into an upper pressure chamber 92 of the slide bore 83. A conduit 93 which is in connection with conduit 81 opens into an annular groove 94 of the slide bore 83, which groove is positioned above the groove 90. A conduit 95 branches from the conduit 93. Conduit 95 in turn opens into the outlet chamber of the pressure-limiting valve 88. A conduit 96 extends from the bore 83 at the place between two annular grooves 90 and 94. Conduit 96 projects to the recess 15 of the central housing portion 10 of the pump.

The pressure from the feeding line 80 acts on the control slide 84 in the pressure chamber 92. Loading pressure available at the consumer line at the moment acts on the opposite side of the slide while the control spring 85 also acts at this side on the control slide 84. If the feeding pressure prevailing in the line 80 is greater than the loading pressure prevailing in the chamber 86 plus the force of spring 85 the control slide will be displaced downwardly so that the connection between conduit 89 and conduit 96 will be established. The pressure medium can now flow into the recess 15 and there build up the pressure by which pistons 14 will be lifted from the eccentric 16. The pump now will no longer convey the pressure medium until the pressure in the pressure chamber 92 will be respectively reduced. Upon reaching a maximal pressure in the system, the pressure-limiting valve 88 opens whereby a so-called pressure separation will be obtained, that is an operational condition in which the medium is no longer conveyed.

The pump according to the present invention which is formed as a constant pump also has the advantages of the adjustment pump, which substantially reduces expenses. Moreover, with the pump of this invention, the combination of the suction throttling, load-sensing technique, for example as shown in FIG. 7, and a feeding flow depending on the number of revolution are obtained. The pump can also be formed as a multiple pump.

It will be understood that each of the elements described above, or two or more together, may also find a useful application in other types of radial piston pumps differing from the types described above.

While the invention has been illustrated and described as embodied in a radial piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a radial piston pump comprising a housing formed with a plurality of radially extending bores receiving a plurality of radial pistons; a drive shaft; an eccentric arranged on said shaft, said pistons having inner faces supported on said eccentric; two end covers supporting said shaft at two ends thereof and closing said housing, each bore having an outlet passage; a plurality of outlet valves each positioned in a respective bore and connected to a respective outlet passage, each outlet valve including a valve body, a spring loading said valve body in a closing direction, and a valve seat; and an annular suction passage formed in one of said end covers and connected to said bores, the improvement comprising a sealing disc positioned between one of said end covers and a side of said housing facing said one end cover, said sealing disc having at least one substantially annular and sealed through passage (42, 76, 77) connecting said outlet passages to said bores, and a plurality of suction throttling through passages (47) each connected to said annular suction passage and to a respective one of said bores, whereby an amount of a pressure medium sucked through said throttling passages in said sealing disc and thus a pressure medium flow through the pump can be limited.

2. The pump as defined in claim 1, wherein said housing has an inner chamber accomodating said eccentric; and further including a pressure-limiting valve positioned in one of said end covers and loading said inner chamber.

3. The pump as defined in claim 1, wherein sealings are provided at two sides of said through passage.

4. The pump as defined in claim 3, wherein said sealings are glued to said sealing disc.

5. The pump as defined in claim 3, wherein said sealings are vulcanized on said sealing disc.

6. The pump as defined in claim 1, wherein said housing has an inner chamber accommodating said eccentric; and further including a pressure control valve arranged in connection with said inner chamber, and a plurality of springs each acting on a respective piston whereby said eccentric is set under pressure by said pressure control valve in dependence upon a loading pressure available in a consumer line and each piston is lifted by said pressure from said eccentric against a force of a respective spring.

7. The pump as defined in claim 6, wherein said pressure control valve includes a control slide which is loaded at one side thereof with a feeding pressure and at the other side thereof with a loading pressure; said pressure control valve being connected to said inner chamber by a conduit.

8. The pump as defined in claim 6, wherein said pressure control valve includes a pressure-limiting valve through which a maximal feeding pressure is limited to obtain a pressure separation.

9. The pump as defined in claim 1, wherein said valve body has a disc shape, said spring being a disc-shaped spring biasing said valve body towards said valve seat.

10. The pump as defined in claim 9, said valve body having a head on which said disc-shaped spring acts, said spring also operating as a centering spring, each of said bores being closed with a closing bolt having a cylindrical recess, said spring having one end fitted in said recess and another end supported at and surrounding said head.

11. The pump as defined in claim 9, wherein two disc-shaped springs are provided, said valve body having a shaft extended through a hole formed in said valve seat, said springs acting on said shaft in the closing direction.

12. The pump as defined in claim 9, wherein said sealing disc is formed with two through passages separated from each other for respective outlet passages for individual pump outlets.

* * * * *